US007463221B2

(12) United States Patent
Kim

(10) Patent No.: US 7,463,221 B2
(45) Date of Patent: *Dec. 9, 2008

(54) PLASMA DISPLAY DEVICE AND DRIVING METHOD THEREOF

(75) Inventor: Myoung-Kwan Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/692,024

(22) Filed: Mar. 27, 2007

(65) Prior Publication Data

US 2007/0252788 A1 Nov. 1, 2007

Related U.S. Application Data

(63) Continuation of application No. 11/187,789, filed on Jul. 22, 2005, now Pat. No. 7,230,588.

(30) Foreign Application Priority Data

Jan. 17, 2005 (KR) ..... 10-2005-0004111

(51) Int. Cl.
*G09G 3/28* (2006.01)

(52) U.S. Cl. ..... 345/60; 345/63

(58) Field of Classification Search ..... 345/60–68, 345/102; 315/169.1, 169.4
See application file for complete search history.

(56) References Cited

U.S. PATENT DOCUMENTS 5,745,086 A 4/1998 Weber
6,349,964 B1 2/2002 Acker et al.
7,088,312 B2 8/2006 Ishizuka et al.
7,230,588 B2 * 6/2007 Kim ..... 345/60

(Continued)

FOREIGN PATENT DOCUMENTS

DE 29601257 U1 1/1996

(Continued)

OTHER PUBLICATIONS

Patent Abstracts of Japan, Publication No. 2003-345289, dated Dec. 3, 2003, in the name of Koji Ito.

(Continued)

*Primary Examiner*—Nitin Patel
(74) *Attorney, Agent, or Firm*—Christie, Parker & Hale, LLP

(57) ABSTRACT

A plasma display device. A plasma display panel includes a plurality of address electrodes, a plurality of scan electrodes, and a plurality of sustain electrodes. A temperature detector detects a temperature of the plasma display panel. A controller outputs a scan electrode driving signal to control a reset waveform to be applied during reset periods of a first number of subfields when the detected temperature between a first temperature and a second temperature, and to control a reset waveform to be applied during reset periods of a second number of subfields when the detected temperature is lower than the first temperature and higher than the second temperature. The second number of subfields is greater than the first number of subfields. A scan electrode driver applies the appropriate reset waveform during a reset period of a subfield according to the scan electrode driving signal output from the controller.

18 Claims, 4 Drawing Sheets

U.S. PATENT DOCUMENTS

| | | | |
|---|---|---|---|
| 2005/0035931 | A1 | 2/2005 | Yoo et al. |
| 2005/0057449 | A1 | 3/2005 | Son |

FOREIGN PATENT DOCUMENTS

| | | | |
|---|---|---|---|
| DE | 19925441 | A1 | 6/1999 |
| JP | 4-166452 | | 6/1992 |
| JP | 2003-345289 | A | 12/2003 |
| JP | 2004-37883 | A | 2/2004 |
| JP | 2004-70359 | A | 3/2004 |
| JP | 2004-157291 | A | 6/2004 |
| JP | 2004-226792 | A | 8/2004 |
| JP | 2004-287176 | A | 10/2004 |

OTHER PUBLICATIONS

Patent Abstracts of Japan, Publication No. 2004-037883, dated Feb. 5, 2004, in the name of Kenji Ogawa et al.
Patent Abstracts of Japan, Publication No. 2004-070359, dated Mar. 4, 2004, in the name of Son Ho Kan et al.
Patent Abstracts of Japan, Publication No. 2004-157291, dated Jun. 3, 2004, in the name of Tomohiro Murakoso et al.
Patent Abstracts of Japan, Publication No. 2004-226792, dated Aug. 12, 2004, in the name of Naotaka Kosugi et al.
Patent Abstracts of Japan, Publication No. 2004-287176, dated Oct. 14, 2004, in the name of Hiroyuki Tachibana et al.

* cited by examiner

PLASMA DISPLAY DEVICE AND DRIVING METHOD THEREOF

CROSS-REFERENCE TO RELATED APPLICATION

This application is a continuation application of U.S. patent application Ser. No. 11/187,789, filed on Jul. 22, 2005 and claims priority to and the benefit of Korean Patent Application No. 10-2005-0004111 filed in the Korean Intellectual Property Office on Jan. 17, 2005, the entire content of which is incorporated herein by reference.

BACKGROUND OF THE INVENTION

1. Field of the Invention

The present invention relates to a plasma display device, and more particularly relates to a plasma display device and a method for driving the same.

2. Description of the Related Art

A plasma display device is a flat panel display that uses plasma generated by gas discharge to display characters and images. It includes, depending on its size, more than several scores to millions of pixels arranged in a matrix pattern.

In general, one frame of a plasma display panel (PDP) is divided into a plurality of subfields, and grayscales are expressed by combinations of the respective subfields. Each subfield includes a reset period, an address period, and a sustain period. The reset period is for erasing wall charges formed by a previous sustain discharge and setting up the wall charges so that the next addressing can be stably performed. The address period is for selecting turn-on/turn-off cells (i.e., cells to be turned on or off) in a panel and accumulating wall charges to the turn-on cells (i.e., addressed cells). The sustain period is for causing a sustain discharge for displaying an image on the addressed cells.

In such a plasma display device, a main reset waveform is applied during a reset period and a weak discharge is generated during a rising period of the main reset waveform, thereby causing contrast deterioration. Accordingly, an auxiliary reset waveform and the main reset waveform are selectively applied during the reset period to thereby enhance the contrast. The main reset waveform is applied during the first two to three subfields, and the auxiliary reset waveform is applied in the other subfields. In this instance, the main waveform includes a rising period for accumulating wall charges and a falling period for eliminating the wall charges.

When the auxiliary reset waveform is applied, negative wall charges and positive wall charges are insufficiently accumulated on a scan (Y) electrode and a sustain (X) electrode, respectively, as compared to the main reset waveform because the auxiliary waveform does not include the rising period. In addition, when the main reset waveform is applied, a reset discharge is generated in every cell and thus a sufficient amount of priming particles is formed in the cell when the main reset waveform is applied. However, when the auxiliary reset waveform is applied, the reset discharge is generated in cells that have experienced a discharge during a falling period in a previous subfield and thus the priming particles are insufficiently formed.

If a temperature is low (e.g., lower than −15° Celsius) when the auxiliary reset waveform is being applied, wall charges are insufficiently accumulated and priming particles are insufficiently formed. Thus, motion of the wall charges becomes slow, and accordingly, a strong misfiring may be generated during the address period.

In addition, if the temperature is high (e.g., higher than 60° Celsius), the amount of wall charges accumulated after the auxiliary reset waveform is applied is too small and the priming particles are insufficiently formed. Further, the motion of the wall charges becomes too active, and accordingly, a strong misfiring may be generated during the address period.

SUMMARY OF THE INVENTION

In accordance with the present invention a plasma display device and a method for driving the same is provided having the advantage of preventing a misfiring during an address period when a temperature is low or high.

In one aspect of the present invention, a plasma display device includes a plasma display panel, a temperature detector, a controller, and a scan electrode driver. The plasma display panel has a plurality of address electrodes, a plurality of scan electrodes, and a plurality of sustain electrodes. The temperature detector detects a temperature of the plasma display panel. The controller outputs a scan electrode driving signal to control a main reset waveform to be applied during reset periods of a first number of subfields when the detected temperature is between a first temperature and a second temperature, and to control the main reset waveform to be applied during reset periods of a second number of subfields when the detected temperature is lower than the first temperature or higher than the second temperature, the second number of subfields being greater than the first number of subfields. The scan electrode driver applies the appropriate reset waveform during a reset period of a subfield according to the scan electrode driving signal output from the controller.

In another aspect of the present invention, a method is provided for driving a plasma display device, wherein during reset periods of entire subfields, a main reset waveform that decreases after gradually increases from a first voltage to a second voltage and an auxiliary reset waveform that decreases from a third voltage to a fourth voltage are selectively applied. The method includes detecting a temperature of a plasma display panel; applying a main reset waveform during reset periods of a first number of subfields among the entire subfields when the detected temperature is between a first temperature and a second temperature; and applying the main reset waveform during reset periods of a second number of subfields when the detected temperature is lower than the first temperature or higher than the second temperature, the second number being greater than the first number.

DETAILED DESCRIPTION

Figure 1:
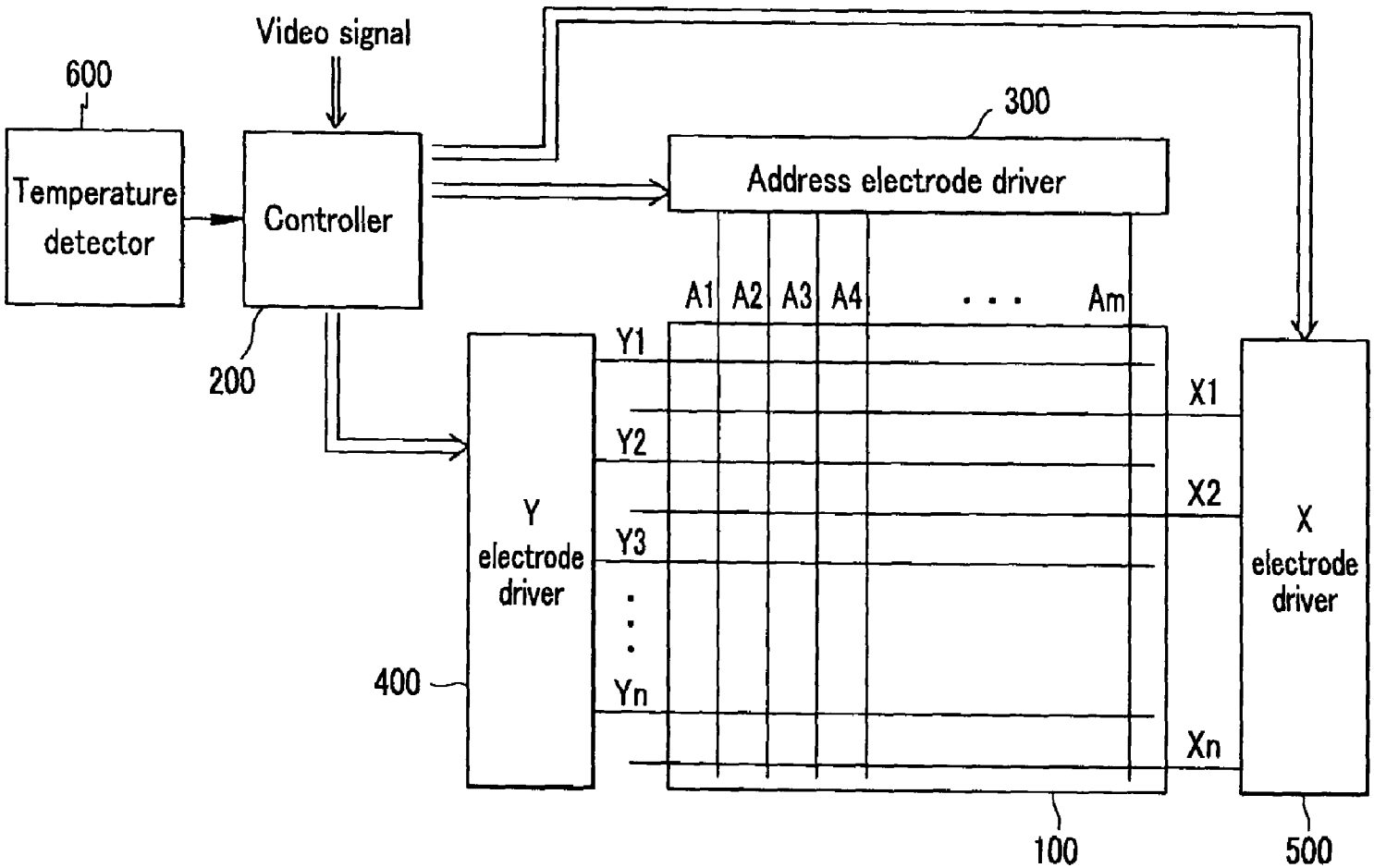
FIG. 1 is a schematic diagram of a plasma display device according to an exemplary embodiment of the present invention.

Referring to FIG. 1, the plasma display device includes a temperature detector 600, a PDP 100, a controller 200, an address electrode driver 300, a scan (Y) electrode driver 400, and a sustain (X) electrode driver 500. The PDP 100 includes a plurality of address electrodes A1-Am extending in a column direction, and a plurality of X electrodes X1-Xn and a plurality of Y electrodes Y1-Yn extending in a row direction. The respective X electrodes X1-Xn correspond to the respective Y electrodes Y1-Yn, and their ends are coupled in common. The PDP 100 includes a glass substrate (not shown) on which the X and Y electrodes X1-Xn and Y1-Yn are arranged and a glass substrate (not shown) on which the address electrodes A1-Am are arranged. The two glass substrates are arranged to face with each other with a discharge space between the two glass substrates so that the Y electrodes Y1-Yn may cross the address electrodes A1-Am and the X electrodes X1-Xn. In this instance, discharge spaces provided at the points where the address electrodes A1-Am cross the X and Y electrodes X1-Xn and Y1-Yn form discharge cells. The temperature detector 600 detects a surrounding temperature or a room temperature of the PDP 100 and outputs a detected temperature. The controller 200 receives image data and outputs and an address driving signal, an X electrode driving signal, and a Y electrode driving signal. In addition, the controller 200 receives a video signal, generates subfield data, and outputs the subfield data as the address electrode driving signal. When determining that the detected temperature is a low temperature or a high temperature, the controller 200 generates the Y electrode driving signal and the X electrode driving signal such that a main reset waveform is applied during reset periods of the entire subfields. The address electrode driver 300 receives the address electrode driving signal from the controller 200 and applies the display data signal to the respective address electrodes A1-Am for selecting turn-on discharge cells. The X electrode driver 500 receives the X electrode driving signal from the controller 200 and applies a driving voltage to the X electrodes X1-Xn. The Y electrode driver 400 receives the Y electrode driving signal from the controller 200 and applies the main reset waveform to the Y electrodes Y1-Yn during the respective reset periods of the entire subfields.

An operation of such a plasma display device according to an exemplary embodiment of the present invention will now be described in more detail.

Figure 2:
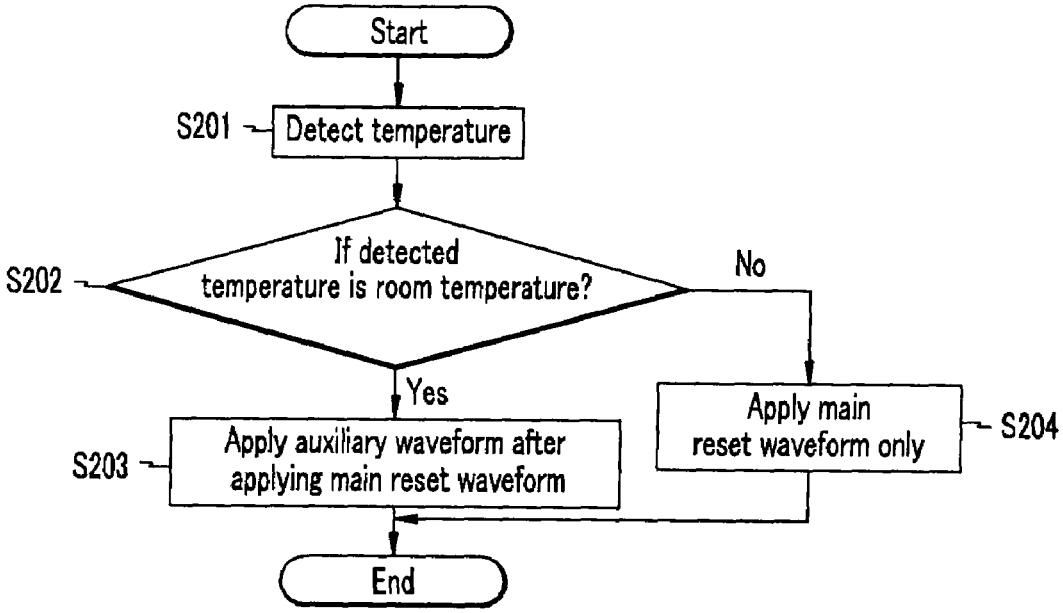
FIG. 2 is a flowchart of a plasma display device according to an exemplary embodiment of the present invention.
Figure 3:
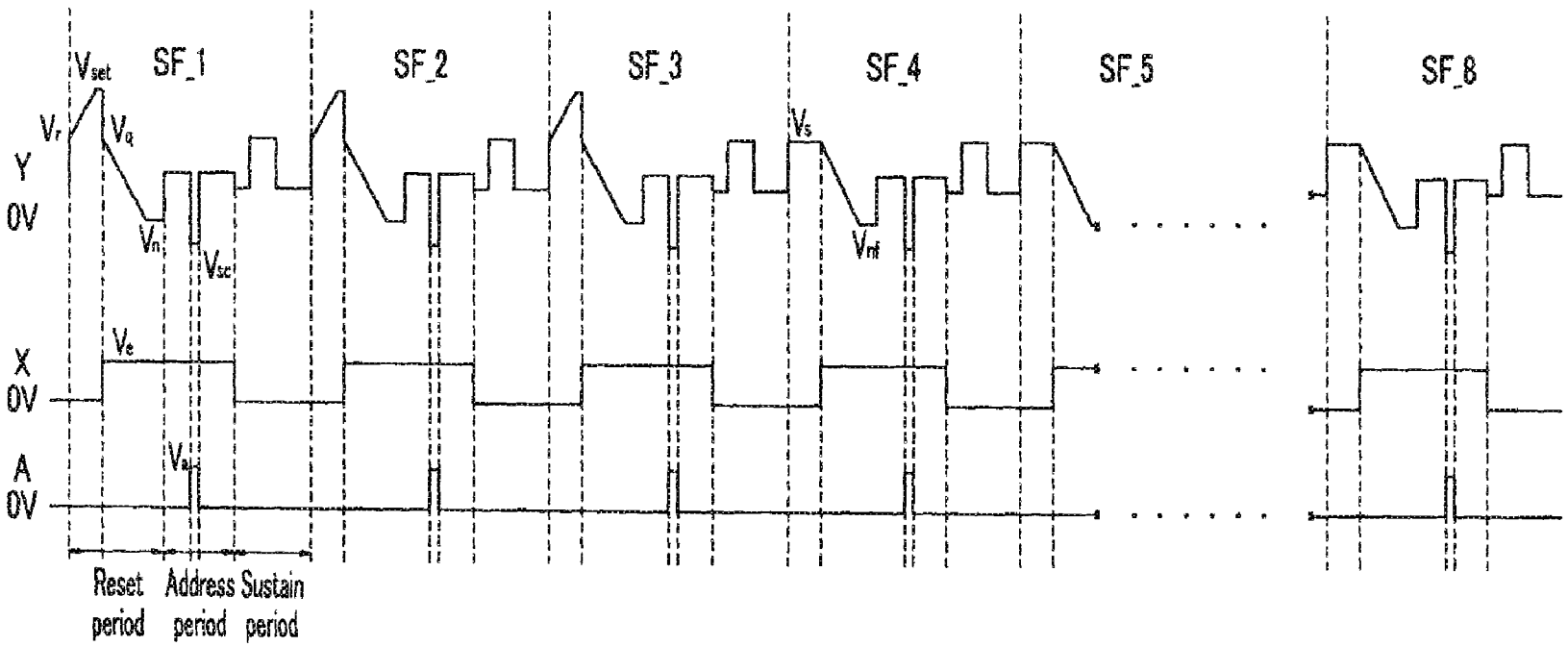
FIG. 3 is a driving waveform diagram of a scan electrode in a room temperature according to an exemplary embodiment of the present invention.

FIG. 2 is a flowchart of a plasma display device according to an exemplary embodiment according to the present invention, and FIG. 3 is a driving waveform of a representative scan (Y) electrode, sustain (X) electrode, and address (A) electrode of a plasma display device in a room temperature according to an exemplary embodiment of the present invention.

An exemplary main reset waveform and auxiliary reset waveform are described as follows, however, those skilled in the art can appreciate that specific patterns of the waveforms may vary.

The main reset waveform is a reset waveform that initializes cells by a reset discharge. For example, the reset waveform includes a rising period and a falling period. Referring to FIG. 3, during the rising period of the main reset waveform, a voltage that gradually increases from a voltage Vr to a voltage Vset is applied to the Y electrodes Y1-Yn while the X electrodes X1-Xn and the address electrodes A1-Am are maintained at a reference voltage (e.g., 0V in FIG. 3). As a result, a weak discharge is generated between the address electrodes A1-Am and the X electrodes X1-Xn from the Y electrodes Y1-Yn, and negative (−) wall charges are formed on the Y electrodes Y1-Yn and positive (+) wall charges are formed on the address electrodes A1-Am and the X electrodes X1-Xn. When the voltage of the Y electrode gradually changes, a weak voltage is generated in the cell and wall charges are formed so that a sum of wall voltages in the cell and an externally applied voltage may be maintained at a discharge firing voltage. Such a process for forming wall charges is disclosed in U.S. Pat. No. 5,745,086 by Weber. The voltage Vset is set to be high enough to generate discharges at the cells since the cells are to be reset during the reset period of a first subfield.

During the falling period of the reset period, a voltage that gradually decreases from a voltage Vq to a voltage Vn is applied to the Y electrodes Y1-Yn. In this instance, the address electrodes A1-Am are applied with the reference voltage (0V), and the X electrodes X1-Xn are applied with a voltage Ve. A weak discharge is then generated between the Y electrodes Y1-Yn and the X electrodes X1-Xn and between the Y electrodes Y1-Yn and the address electrodes A1-Am while the voltage of the Y electrodes Y1-Yn decreases. As a result, the negative (−) wall charge formed on the Y electrodes Y1-Yn and the positive (+) wall charges formed on the X electrodes X1-Xn and the address electrodes A1-Am are eliminated.

The auxiliary reset waveform is a reset waveform for initializing cells selected in a previous subfield. For example, the auxiliary waveform includes a falling period only. Referring to FIG. 3, during the falling period of the auxiliary reset waveform, starting at subfield SF_4, a voltage that gradually decreases from a voltage Vs to the voltage Vnf is applied to the Y electrodes Y1-Yn while the X electrodes X1-Xn are biased at 0V. Then a weak discharge is generated in the cells selected in the previous subfield and experienced the sustain discharge, and non-selected cells do not undergo the weak discharge. In other words, since the positive (+) wall charges are formed on Y electrodes and the negative (−) wall charges are formed on X electrodes of the cells that are selected in the previous subfield, the reset discharge is generated only when the voltage that gradually decreases is applied. Herein, the voltage is similar to the auxiliary waveform. A condition of wall charges in cells that are not selected in the previous subfield is maintained at a condition of the end of the falling period of the previous period because the sustain discharge has not been generated during the sustain period of the previous subfield. Therefore, the reset discharge is not generated even though the auxiliary waveform of gradually decreasing voltage is applied.

Referring now to FIG. 2, the temperature detector 600 detects a surround temperature or a room temperature of the PDP 100, and output a detected result in step S201.

The controller 200 determines whether the detected result is at a room temperature, for example, between at −15° Celsius and at 60° Celsius in step S202. In this instance, the room temperature is neither a high temperature nor a low temperature. For example, the high temperature is set to be higher than 60° Celsius and the low temperature is set to be lower than −15° Celsius. In this instance, a reference temperature of the low temperature is set to be −15° Celsius, but it may be set between −10° Celsius and −20° Celsius, or at a lower range as necessary. A reference temperature of the high temperature is set to be 60° Celsius but it may also set between 55° Celsius and 65° Celsius or at a higher range as necessary.

If the temperature is room temperature, the controller 200 controls the main reset waveform to be applied to first three subfields (i.e., in the early stage among all the subfields) and generates the Y electrode driving signal and the X electrode driving signal to apply them to other subfields. Further, the controller 200 generates a video signal as subfield data such that the address electrode driving signal is generated in step S203.

Then the Y electrode driver 400, the X electrode driver 500, and the address electrode driver 500 respectively apply waveforms of FIG. 3 to the Y electrodes according to the Y electrode driving signal, the X electrode driving signal, and the address electrode driving signal.

Referring back to FIG. 3, the first three subfields SF_1-SF_3 in the early stage are applied with the main reset waveform that includes the rising and falling periods during the reset period. In this instance, during the rising period, a voltage that gradually increases from the voltage Vr to the voltage Vset is applied to the Y electrodes Y1-Yn while maintaining the X electrodes X1-Xn and the address electrodes A1-Am at the reference voltage (e.g., 0V). In addition, during the falling period, a voltage that gradually increases from the voltage Vq to the voltage Vn is applied to the Y electrodes Y1-Yn, the reference voltage (e.g., 0V) is applied to the address electrodes A1-Am, and the voltage Ve is applied to the sustain electrodes X1-Xn.

Subsequently, a scan pulse of a voltage Vsc is sequentially applied to the Y electrodes Y1-Yn for selecting turn-on cells, and an address pulse of the voltage Va is applied to address electrodes that cross the selected cells.

Then an address discharge is generated in the cell where the address electrodes applied with the voltage Va and the Y electrodes applied with the voltage Vsc cross, and positive (+) wall charges are formed on the Y electrodes and negative (−) wall charges are formed on the X electrodes.

Subsequently, during the sustain period, a sustain pulse of a voltage Vs is alternately applied to the Y electrodes Y1-Yn and the X electrodes X1-Xn to trigger a sustain discharge in the addressed cells during the address period. In this instance, no address discharge is generated in cells that are not addressed during the address period because no address discharge is generated. Herein, the number of sustain discharge pulses applied to all the subfields is set to be equal to each other for convenience of description, but the number of sustain discharge pulses applied to each subfield corresponds to weight value expressed by the corresponding subfield.

In other subfields SF_4-SF_8, the auxiliary waveform is applied to the Y electrodes during the reset period. During the falling period of the reset period, a voltage that gradually decreases from the voltage Vs to the voltage Vnf is applied to the Y electrodes Y1-Yn while the X electrodes X1-Xn are biased at 0V.

During the respective address periods and sustain periods of other subfields SF_4-SF_8 are applied with waveforms which are equivalent to the waveforms applied to the subfields SF_1-SF_3 in which the main reset waveform is applied.

Figure 4:
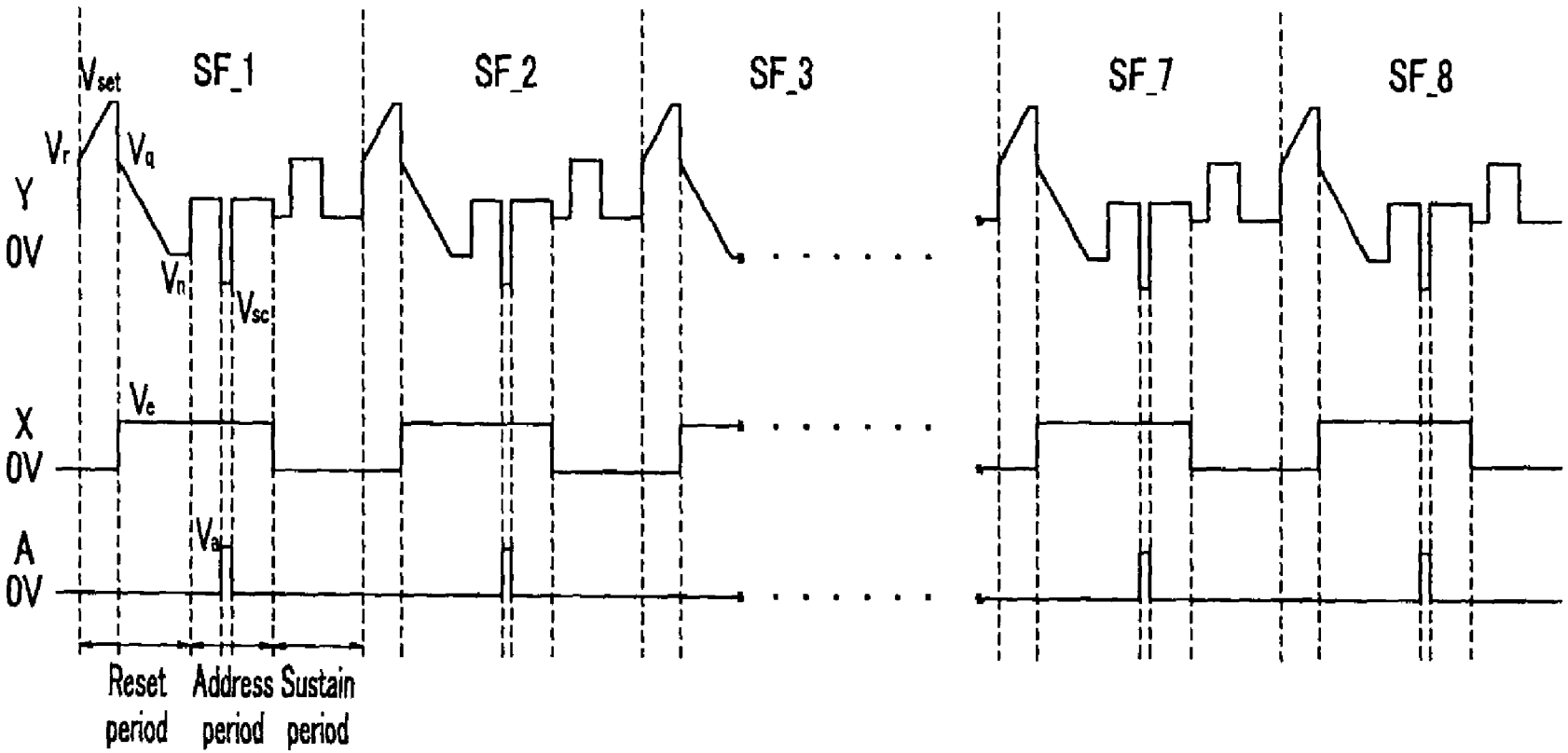
FIG. 4 is a driving waveform diagram of a plasma display in a high or low temperature according to an exemplary embodiment of the present invention.

When the detected result is determined to be a low temperature or a high temperature in step S202, the controller generates the respective driving signals to applying main reset waveform to the entire subfields in step S204 and applies waveforms of FIG. 4 to the Y electrode driver 400, the X electrode driver 500, and the address electrode driver 500 according to the respective driving signals.

FIG. 4 is a driving waveform diagram of a scan electrode of a plasma display device in a high temperature or a low temperature according to an exemplary embodiment of the present invention. During the reset periods of the respective subfields SF_1-SF_8, the main reset waveform is applied and waveforms applied during the address and sustain periods are already described above with reference to FIG. 3, and thus will not be further described. As shown in FIG. 4, when the main reset waveform is applied during the reset periods of the respective subfields while the PDP is in the low temperature or the high temperature, all the cells experience a reset discharge such that a large amount of priming particles are formed and wall charges are stably accumulated. As a result, a stable address discharge is generated even though motion of the charges is slow or fast during the address period.

According to such a process, the PDP 100 displays corresponding image data.

According to the above embodiments, the main reset waveform may be applied to all the subfields. However, the number of subfields or an order of subfields applied with the main reset waveform may also be controlled corresponding to a temperature as necessary.

According to the embodiments of the present invention, a plasma display device and a method for driving the same may be provided to realize high quality image in a low temperature or a high temperature.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display device for displaying an image during a frame comprising a plurality of subfields, said plasma display device comprising:

a plasma display panel comprising a plurality of discharge cells for displaying the image, a plurality of address electrodes, a plurality of scan electrodes, and a plurality of sustain electrodes; and a scan electrode driver adapted to apply a reset waveform during a reset period to at least one of the scan electrodes, said reset waveform comprising a main reset waveform or an auxiliary reset waveform having a waveform different from the main reset waveform, wherein the scan electrode driver is adapted to apply a first number of at least one said main reset waveform to the at least one of the scan electrodes during the frame when a peripheral temperature of the plasma display panel is higher than a first temperature, and to apply a second number of at least one said main reset waveform to the at least one of the scan electrodes during the frame when the peripheral temperature of the plasma display panel is less than or equal to the first temperature, the first number being larger than the second number.

2. The plasma display device of claim 1, wherein the first temperature is between 55° Celsius and 65° Celsius.

3. The plasma display device of claim 1, further comprising a temperature detector for detecting the peripheral temperature of the plasma display panel.

4. The plasma display device of claim 1, wherein the main reset waveform is configured to initialize all of the discharge cells.

5. The plasma display device of claim 4, wherein the main reset waveform is gradually decreased from a third voltage to a fourth voltage after being gradually increased from a first voltage to a second voltage.

6. The plasma display device of claim 1, wherein the auxiliary reset waveform has a maximum value lower than that of the main reset waveform.

7. A plasma display device for displaying an image during a frame comprising a plurality of subfields, said plasma display device comprising:

a plasma display panel comprising a plurality of discharge cells for displaying the image, a plurality of address electrodes, a plurality of scan electrodes, and a plurality of sustain electrodes; and a scan electrode driver adapted to apply a reset waveform during a reset period to at least one of the scan electrodes, said reset waveform comprising a main reset waveform or an auxiliary reset waveform having a waveform different from the main reset waveform, wherein the scan electrode driver is configured to apply a first number of at least one said main reset waveform to the at least one of the scan electrodes when a peripheral temperature of the plasma display panel is higher than or equal to a first temperature, and to apply a second number of at least one said main reset waveform to the at least one of the scan electrodes when the peripheral temperature of the plasma display panel is less than the first temperature, the first number being smaller than the second number.

8. The plasma display device of claim 7, wherein the first temperature is between −10° Celsius and −20° Celsius.

9. The plasma display device of claim 7, further comprising a temperature detector for detecting the peripheral temperature of the plasma display panel.

10. The plasma display device of claim 7, wherein the main reset waveform is configured to initialize all of the discharge cells.

11. The plasma display device of claim 10, wherein the main reset waveform is gradually decreased from a third voltage to a fourth voltage after being gradually increased from a first voltage to a second voltage.

12. The plasma display device of claim 7, wherein the auxiliary reset waveform has a maximum value lower than that of the main reset waveform.

13. A plasma display device for displaying an image during a frame comprising a plurality of subfields, said plasma display device comprising:

a plasma display panel comprising a plurality of discharge cells for displaying the image, a plurality of address electrodes, a plurality of scan electrodes, and a plurality of sustain electrodes; and a scan electrode driver adapted to apply a reset waveform during a reset period to at least one of the scan electrodes, said reset waveform comprising a main reset waveform or an auxiliary reset waveform having a waveform different from the main reset waveform, wherein the scan electrode driver is adapted to apply a first number of at least one said main reset waveform to the at least one of the scan electrodes during the frame when a peripheral temperature of the plasma display panel is between a first temperature and a second temperature which is higher than the first temperature, and to apply a second number of at least one said main reset waveform to the at least one of the scan electrodes during the frame when the peripheral temperature of the plasma display panel is less than the first temperature or greater than the second temperature, the first number being smaller than the second number.

14. The plasma display device of claim 13, wherein the first temperature is between −10° Celsius and −20° Celsius, and the second temperature is between 55° Celsius and 65° Celsius.

15. The plasma display device of claim 13, further comprising a temperature detector for detecting the peripheral temperature of the plasma display panel.

16. The plasma display device of claim 13, wherein the main reset waveform is configured to initialize all of the discharge cells.

17. The plasma display device of claim 16, wherein the main reset waveform is gradually decreased from a third voltage to a fourth voltage after being gradually increased from a first voltage to a second voltage.

18. The plasma display device of claim 13, wherein the auxiliary reset waveform has a maximum value lower than that of the main reset waveform.

* * * * *